US005203921A

United States Patent [19]

Yamashita et al.

[11] Patent Number: 5,203,921

[45] Date of Patent: Apr. 20, 1993

[54] APPARATUS FOR PAINTING SHEAR CAULKED PART OF BRAKE BOOSTER

[75] Inventors: Shinichi Yamashita; Hidefumi Inoue, both of Saitama, Japan

[73] Assignee: Jidosha Kiki Co., Ltd., Tokyo, Japan

[21] Appl. No.: 643,447

[22] Filed: Jan. 18, 1991

[30] Foreign Application Priority Data

Feb. 14, 1990 [JP] Japan ..... 2-33177

[51] Int. Cl.[5] ..... B05D 1/02; B05B 13/00

[52] U.S. Cl. ..... 118/320; 427/422; 427/425

[58] Field of Search ..... 427/422, 424, 425; 118/320

[56] References Cited

U.S. PATENT DOCUMENTS 3,819,403 6/1974 Hogstrom ..... 427/422

5,065,694 11/1991 Earnheart, Jr. ..... 118/320

*Primary Examiner*—Marianne Padgett

*Attorney, Agent, or Firm*—Flynn, Thiel, Boutell & Tanis

[57] ABSTRACT

An apparatus for painting a portion of a two piece shell of a brake booster joined together by a caulking operation. The two pieces are disposed in opposing relationship to each other, and a shear caulking operation is applied to the outer periphery thereof at a plurality of locations, thereby joining the pieces together to define a shell. The shell is held so as to be rotatable about its axis, and a nozzle of a paint applicator is disposed in opposing relationship with the outer periphery of the shell. By rotating the shell through a given angle, paint is applied to successive caulked portions.

3 Claims, 3 Drawing Sheets

APPARATUS FOR PAINTING SHEAR CAULKED PART OF BRAKE BOOSTER

BACKGROUND OF THE INVENTION

The invention relates to an apparatus for applying a paint to a shear caulked portion around the outer periphery of a shell as may be used in a brake booster which may be formed by a pair of cylindrical or circular members caulked together.

A shell used for a brake booster generally comprises a cup-shaped or a substantially cylindrical member having a bottom and a circular or dish-shaped member, which are both painted and then dried before assembly. These members are disposed in abutment against each other, and are joined together by caulking them together after a peripheral margin formed by the abutment has been sheared off.

The shear caulked portion includes an exposed metal which is likely to give rise to the occurrence of a rust, and thus requires a painting to prevent such rust. In the prior art practice, a substantially cylindrical shell which is formed by the caulking operation and which is to be painted is disposed so that the axis thereof is disposed at an angle and so that the shell is rotatable about the axis. A vessel containing a quantity of paint which is sufficient to allow the shear caulked portion extending around the outer periphery of the shell to be immersed therein is disposed below the shell, and the painting is applied to the shell while rotating it (see Japanese Laid-open Patent Application No. 242,163/1989). However, applying the paint by immersing the shell in the paint vessel involves a wasteful use of the paint and the run down of the paint, which degrades the appearance, resulting in an inefficient operation and a difficulty to achieve a uniform painting.

SUMMARY OF THE INVENTION

Accordingly, it is an object of the invention to provide an apparatus for painting a shear caulked portion of a brake booster which is capable of performing an efficient anti-rust paint applying operation in a reduced length of time while assuring a satisfactory application of the paint to the desired location or locations.

DESCRIPTION OF EMBODIMENT

Figure 1:
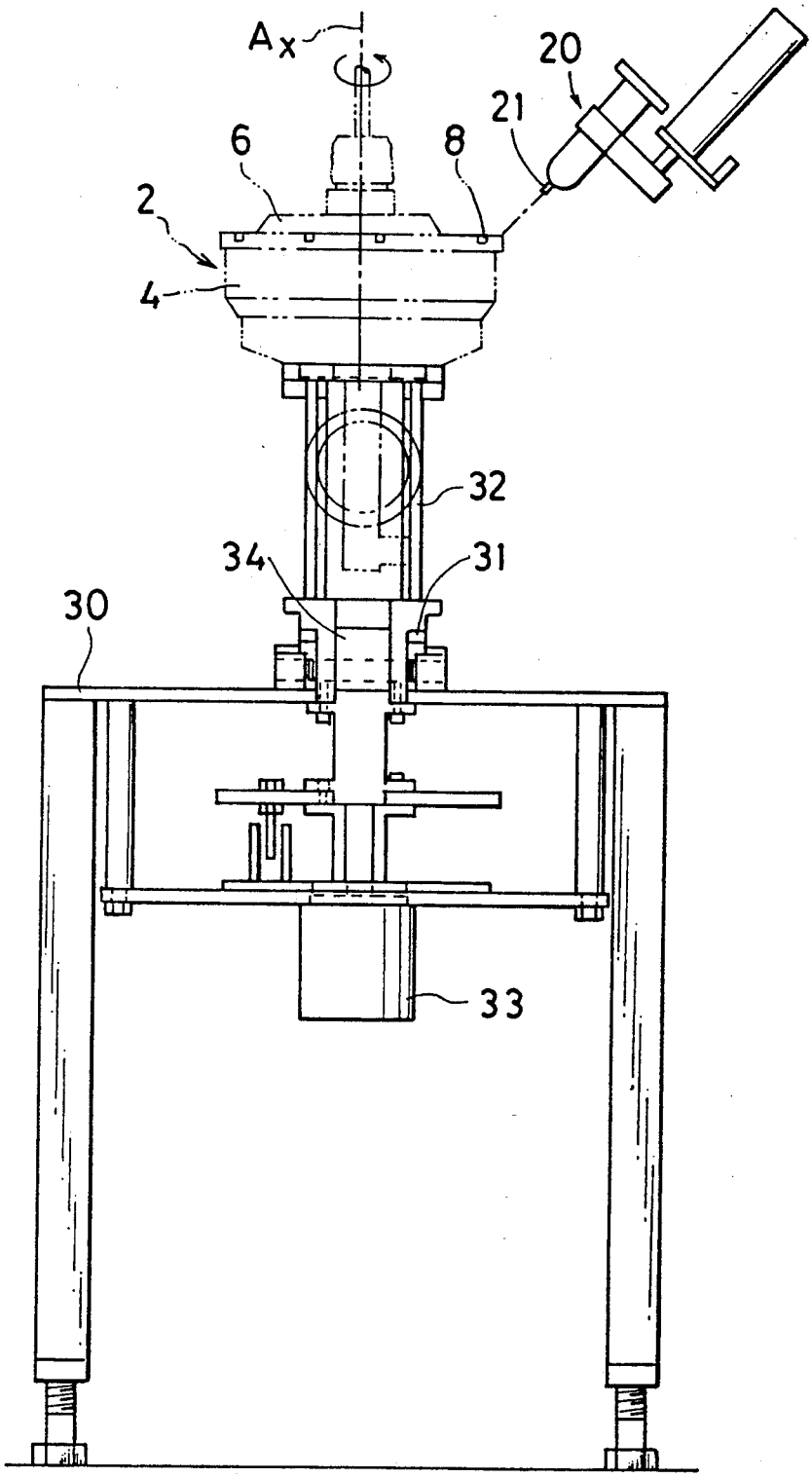
FIG. 1 is a schematic view of an apparatus for applying according to one embodiment of the invention.
Figure 2:
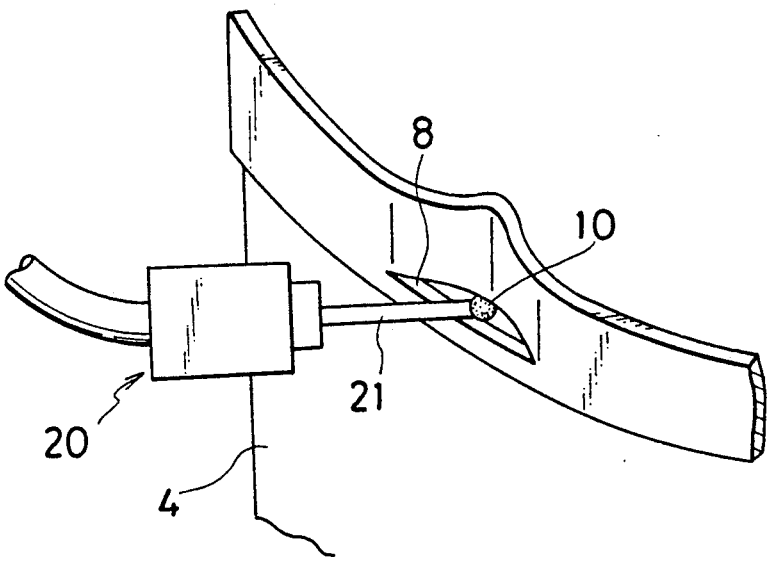
FIG. 2 is a perspective view, to an enlarged scale, of a portion of the shell which is to be painted.
Figure 3:
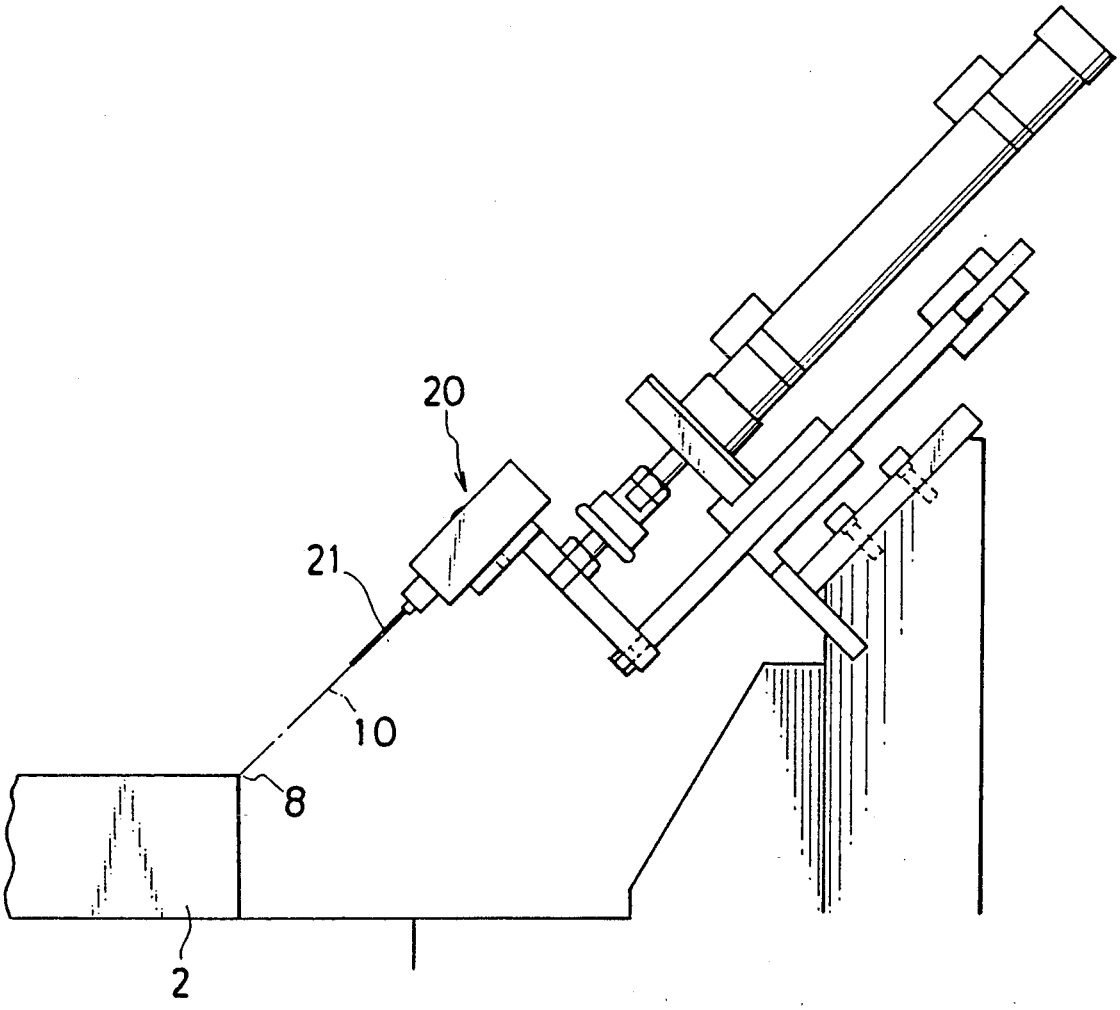
FIG. 3 is a schematic side elevation of a paint applicator.

Referring to the drawings, an embodiment of the invention will be described. FIG. 1 is a schematic view of an overall painting apparatus according to one embodiment of the invention, FIG. 2 is a perspective view, to an enlarged scale, of a portion of the shell which is to be painted, and FIG. 3 is a schematic side elevation of a paint applicator.

Specifically, a brake booster includes a shell 2 comprising a cup-shaped first member 4 (or substantially cylindrical member with a closed bottom) and a disc-shaped second member 6, both of which are individually painted before they are assembled together. The first member 4 has an opening, in which the second member 6 is fitted, and the both members 4, 6 are joined together by shearing the opening at a plurality of locations and caulking it from the outer side.

The shell is held in position with its axis A disposed upright, and a paint applicator 20 is disposed at a position opposite to the outer periphery of the shell where the shear caulked portion 8 is formed. The applicator 20 includes a nozzle 21 which is disposed at a given angle from the vertical so as to project a paint 10 to the caulked portion 8. The shell 2 is then driven to rotate about the axis A, and each time the respective caulked portions 8 come opposite to the nozzle 21, the latter projects the paint 10 to paint the shell. In this manner, all of the caulked portions 8 are painted during one revolution of rotation of the shell 2, thus depositing a proper amount of the paint 10 to the caulked portions 8 within a reduced length of time and in an exact manner.

The painting apparatus will now be described in more detail. The apparatus includes a table 30 carrying a vertically oriented bearing 31 in which a support shaft 32 is journalled for rotatably supporting the shell 2. The support shaft 32 is fitted around a rotary shaft 34 to which a rotating drive is transmitted from rotating means such as a motor 33. By a controller, not shown, the rotation of the motor 33 is controlled, so that it rotates through a given incremental angle so that each of the caulked portions 8 successively comes to a stop at a location opposite to the applicator.

It will be noted that the paint applicator 20 is disposed so as to be located opposite to each of the caulked portions 8 at a given angle from the vertical. Accordingly, the paint applicator 20 is capable of projecting the paint 10 from an associated tank, not shown, to each caulked portion 8 through the nozzle 21 in accordance with the rotation of the shell 2 which is controlled by the controller. In this manner, all of the caulked portions 8 can be successively painted during one revolution of the rotation of the shell 2.

While the invention has been described above in connection with an embodiment thereof, it should be understood that a number of changes, modifications and substitutions therein will readily occur to one skilled in the art without departing from the spirit and scope of the invention as defined by the appended claims.

What is claimed is:

1. In an apparatus for painting a shear caulked portion of a brake booster, said brake booster being comprised of a pair of members disposed in opposing relationship to each other and connected together by shear caulked portions at a peripheral portion of both members which are disposed in abutment against each other, the improvement comprising a support means for supporting the shell for rotation about axis thereof;

a paint applicator means disposed in opposing relation to an outer periphery of the shell and aligned with the shear caulked portions for projecting a paint only to the shear caulked portions; and drive means for intermittently rotating the shell about the axis thereof and through a first angle so that each of the shear caulked portions is successively oriented opposite to the paint applicator so that the paint applicator means can apply a paint only to the shear caulked portions.

2. An apparatus according to claim 1 in which the shell is held with its axis oriented vertically.

3. An apparatus according to claim 2 in which an axis of a paint spray from the paint applicator means is disposed at a second angle to the vertical.

* * * * *